US007040356B2

(12) United States Patent
Tarlow

(10) Patent No.: US 7,040,356 B2
(45) Date of Patent: May 9, 2006

(54) FOOD PRESERVATION CONTAINER

(75) Inventor: Kenneth Tarlow, Corte Madera, CA (US)

(73) Assignee: Sylmark Holdings Limited, (IE)

( * ) Notice: Subject to any disclaimer, the term of this patent is extended or adjusted under 35 U.S.C. 154(b) by 12 days.

(21) Appl. No.: 10/951,944

(22) Filed: Sep. 27, 2004

(65) Prior Publication Data

US 2005/0042337 A1 Feb. 24, 2005

Related U.S. Application Data

(63) Continuation of application No. 10/068,661, filed on Feb. 8, 2002, now abandoned.

(51) Int. Cl.
*B65B 1/04* (2006.01)

(52) U.S. Cl. ..... 141/65

(58) Field of Classification Search ..... 141/65, 141/67, 98; 215/228, 260; 53/432–434, 53/510–512

See application file for complete search history.

(56) References Cited

U.S. PATENT DOCUMENTS

| | | | | |
|---|---|---|---|---|
| 2,994,424 | A | | 8/1961 | Selby et al. |
| 4,984,611 | A | | 1/1991 | Takatsuki et al. |
| 5,031,785 | A | * | 7/1991 | Lemme ..... 215/228 |
| 5,195,427 | A | | 3/1993 | Germano |
| 5,394,789 | A | | 3/1995 | Evans et al. |
| 5,570,628 | A | | 11/1996 | Kiener et al. |
| 5,806,575 | A | | 9/1998 | Tsay |
| 5,845,564 | A | | 12/1998 | Hurst |
| 5,964,255 | A | | 10/1999 | Schmidt |
| 6,019,034 | A | | 2/2000 | Ford, Sr. |
| 6,120,822 | A | | 9/2000 | Denvir et al. |
| 6,245,294 | B1 | | 6/2001 | Goldberg et al. |
| 6,470,924 | B1 | | 10/2002 | Chen |

* cited by examiner

*Primary Examiner*—Steven O. Douglas
(74) *Attorney, Agent, or Firm*—Kathy Mojibi Kavcioglu

(57) ABSTRACT

Food Preservation Container with a main container body and a circular lid. The lid has a built in on-off switch, air pump, ozone generator, timing circuit, pressure switch, vacuum switch, solenoid valve, power indicator light, vacuum indicator light, pressure indicator light and power supply. The container has a circular opening. The opening has a plurality of outwardly facing tabs about its circumference. The lid has a plurality of mating inwardly facing tabs that can interface with said outwardly facing tabs. The lid has a secondary floating inner lid, said inner lid having a soft rubber gasket attached to its perimeter, said inner lid capable of being forced toward the lip of said container opening by a cam attached to a hinged lever located on the front of said circular lid. The components contained within said lid arranged in such a way that said air pump automatically turns on when the user twists said lid onto said container opening thereby activating said on-off switch which turns on said pump. Said pump being automatically turned off when a predetermined pressure or vacuum is reached by means of said pressure switch or said vacuum switch. Said ozone generator is automatically turned on for a predetermined period of time and turned automatically turned off by means of said timing circuit. The air in said container is capable of being periodically released by said solenoid valve that is controlled by said timing circuit.

10 Claims, 6 Drawing Sheets

FOOD PRESERVATION CONTAINER

RELATED APPLICATIONS

This application is a continuation of Ser. No. 10/068,661 filed Feb. 8, 2002 now ABN.

FIELD OF THE INVENTION

This invention relates generally to the field of food storage containers, and more particularly to a food preservation container.

BACKGROUND

Methods for preserving food can be traced back thousands of years. Early man preserved food by drying it thereby eliminating damaging moisture. More recently mankind discovered that foods stay fresh longer when they are kept in a cool environment. In recent times the invention of the refrigerator and freezer have become a prime method of keeping foods fresh. Additionally, in recent times, the application of a vacuum, when sealing foods into jars or cans has proven to extend the usable life of food by eliminating the air that bacteria need to live in. More recently, the concept of keeping fruits, vegetables and flowers fresh by means of positive air pressure has been disclosed by Niedwwietz in his patent U.S. Pat. No. 710,979 issued in July of 1954 and U.S. Pat. No. 2,994,424 issued to Selby on Aug. 1, 1961.

All of the above mentioned methods have been tried and are currently in use in various forms. However, none of the prior art regarding refrigeration, vacuum or pressure or ozone have combined these features into one, easy to use container for keeping all types of food fresh and bacteria free for extended periods of time.

SUMMARY OF THE INVENTION

The primary object of the invention is to provide a food preservation container that allows a person to pressurize or vacuumize the air inside of a storage container to help preserve the life of the food within said container.

Another object of the invention is to provide a food preservation container that adds ozone to the inside of the container to help kill mold and bacteria.

Another object of the invention is to provide a food preservation container that automatically replaces pressurized or vacuumized air at regular intervals to remove build-ups of harmful gasses generated by food within the container.

A further object of the invention is to provide a food preservation container whose lid is easy to remove and replace yet provides an air tight seal.

Yet another object of the invention is to provide a food preservation container that automatically re-pressurizes or re-vacuumizes and re-ozinates the air within the container without the need for the user to be present for the entire operation.

Still yet another object of the invention is to provide a food preservation container that automatically maintains a predetermined pressure or vacuum.

Other objects and advantages of the present invention will become apparent from the following descriptions, taken in connection with the accompanying drawings, wherein, by way of illustration and example, an embodiment of the present invention is disclosed.

A preferred embodiment of the food preservation container of the present invention includes a main container body, a circular lid having an integral side wall, said lid having a built in on-off switch, air pump, ozone generator, timing circuit, pressure switch, vacuum switch, solenoid valve, power indicator light, vacuum indicator light, pressure indicator light and power supply. The container preferably includes a circular opening, said opening having a plurality of outwardly facing tabs about its perimeter, and said lid having a plurality of mating inwardly facing tabs that can interface with said outwardly facing tabs. The lid preferably includes a lower hinge portion that combines with a mating hinge portion on the lower front portion of said container opening. In a preferred embodiment of the invention, the lid includes a secondary floating inner lid, said inner lid having a soft rubber gasket attached to its perimeter, said inner lid capable of being forced toward the lip of said container opening by a cam attached to a hinged lever located on the front of said circular lid. The power supply is preferably removable and replaceable from the front of said lid. The components contained within said lid are preferably arranged in such a way that said air pump automatically turns on when the user twists said lid onto said container opening thereby activating said on-off switch which turns on said pump, said pump being automatically turned off when a predetermined pressure or vacuum is reached by means of said pressure switch or said vacuum switch. The ozone generator automatically turns on for a predetermined period of time and automatically turns off by means of said timing circuit. The ozone generator automatically turns on for a predetermined period of time and automatically turns off by means of said timing circuit. The ozone generator preferably includes a corona discharge tube and a high voltage circuit that powers said tube. The timing circuit includes a microprocessor and discrete electronic components associated with said microprocessor. The air in said container is capable of being periodically released by said solenoid valve that is controlled by said timing circuit.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENT

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
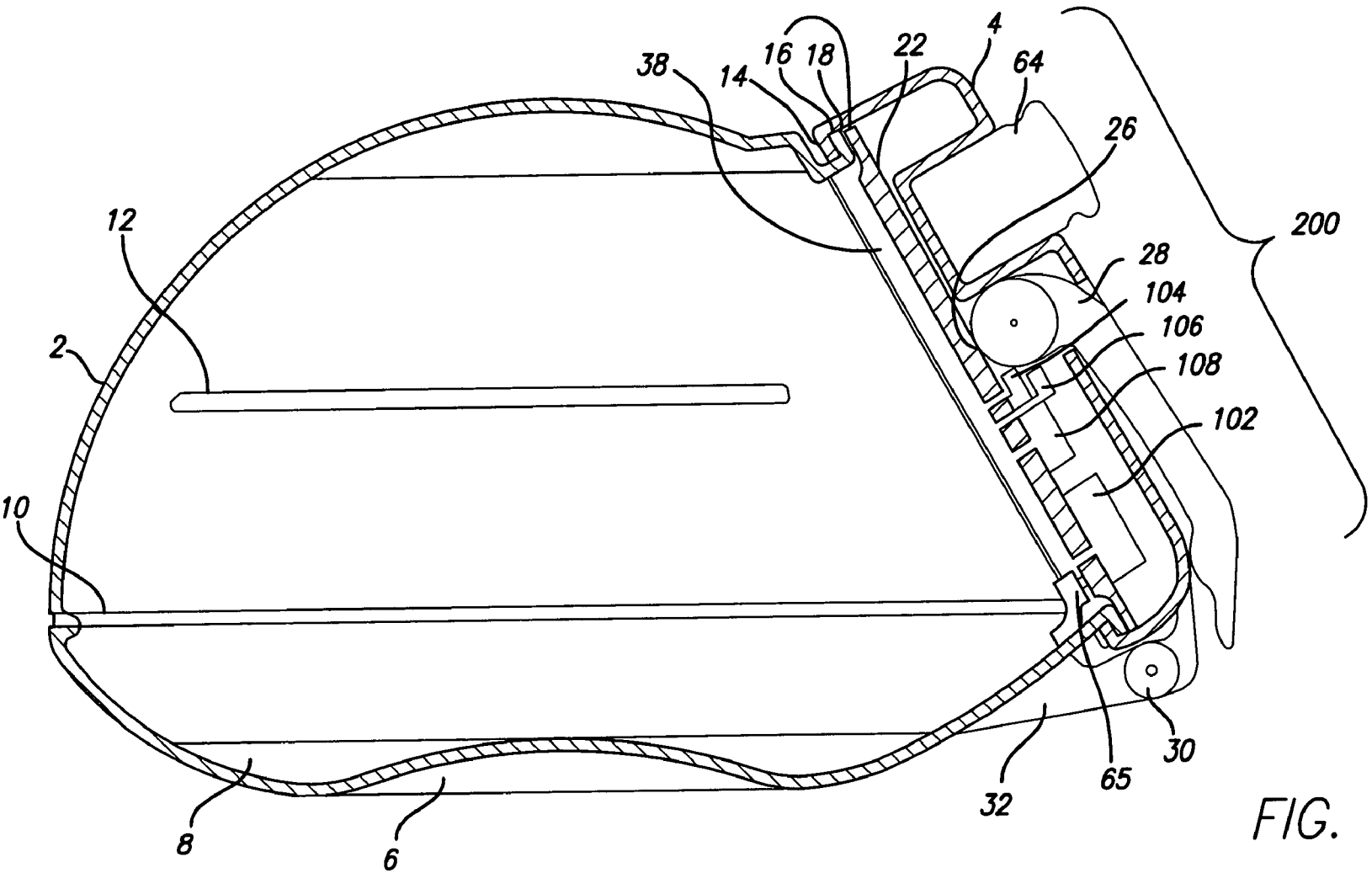
FIG. 1 is a side section view of the food preservation container of the present invention.
Figure 2:
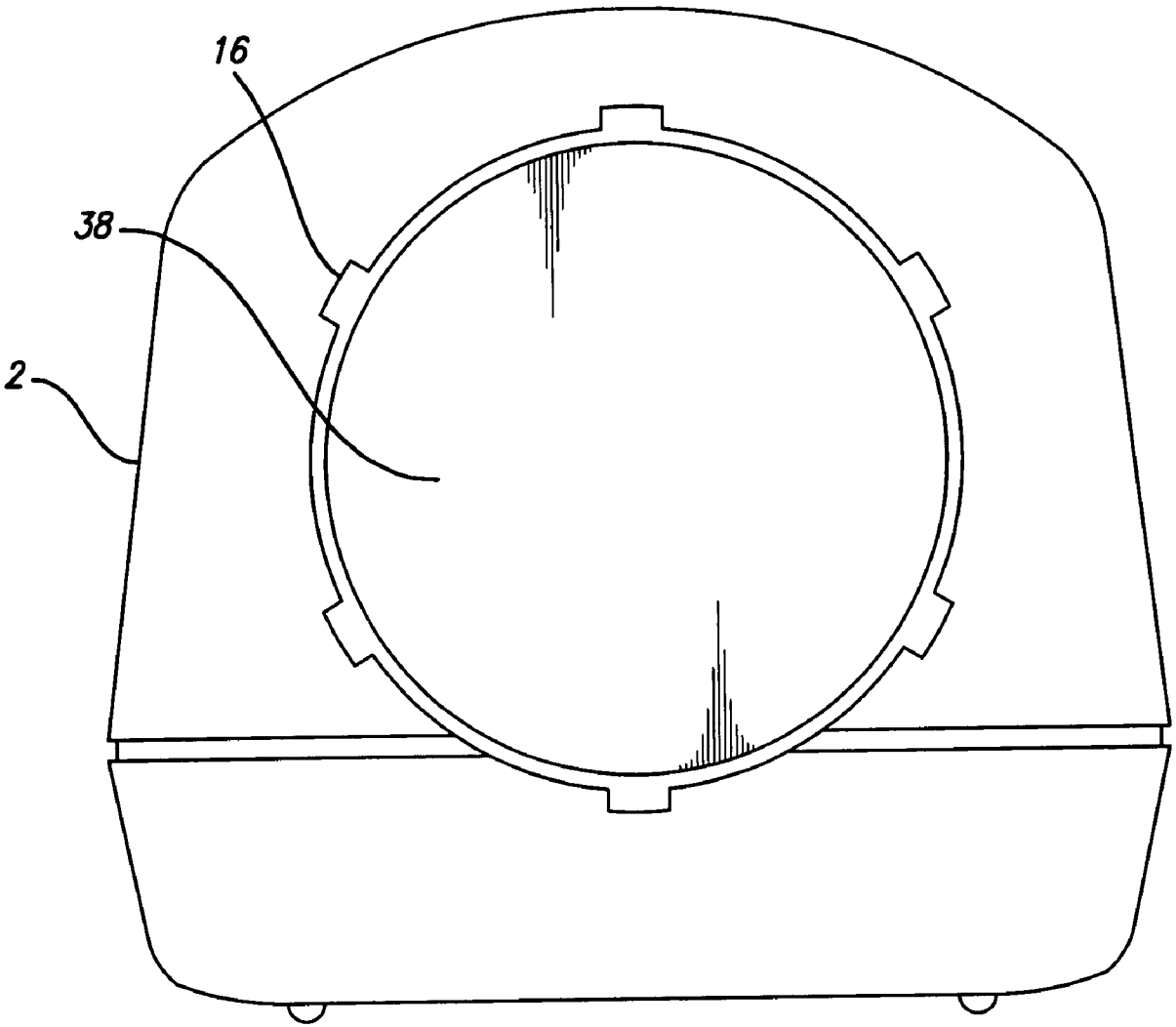
FIG. 2 is a front view of the container minus the lid.
Figure 3:
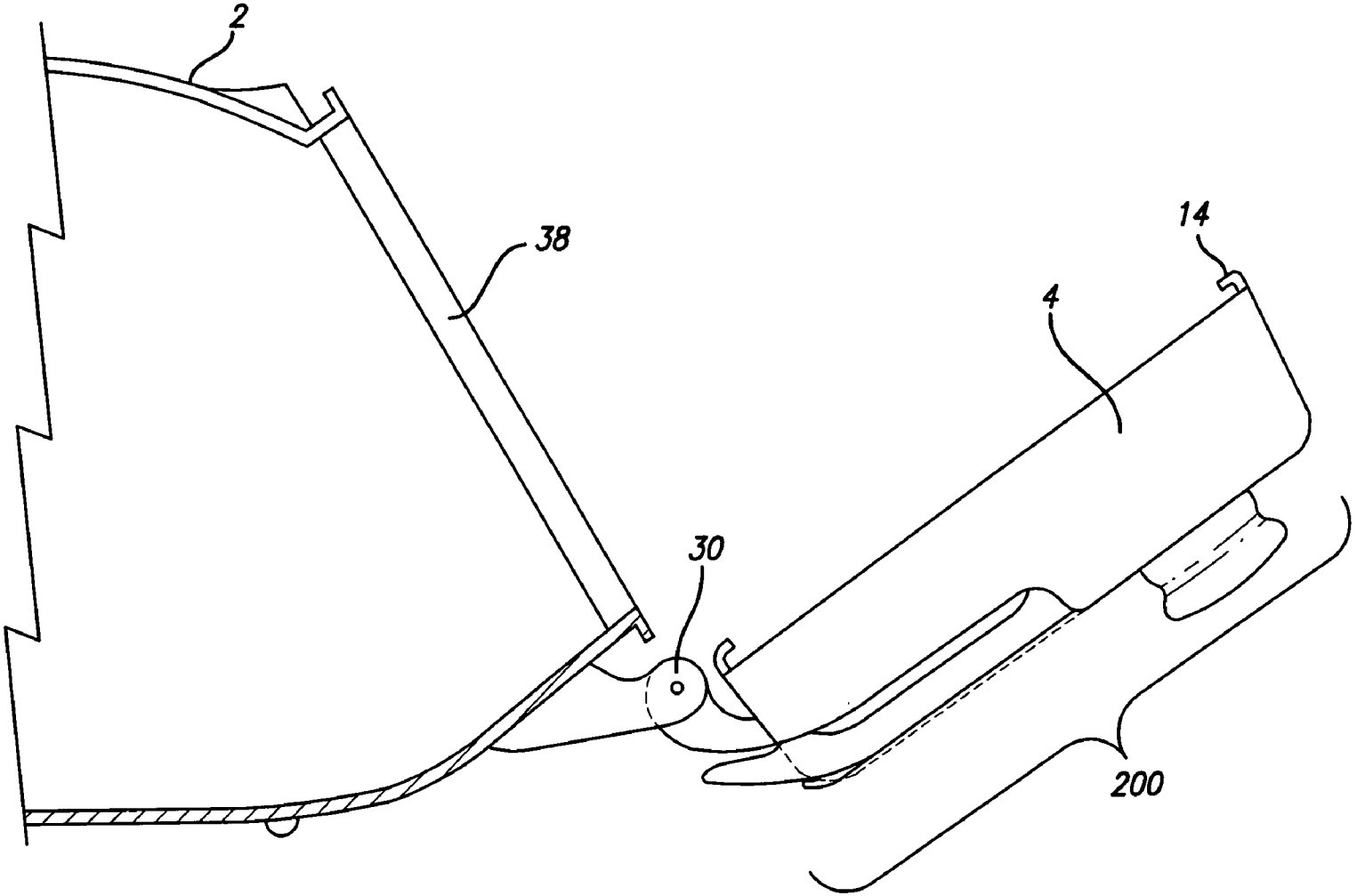
FIG. 3 is a side view of the container showing the lid in the open position.

Referring now to FIG. 1 we see a side view of a preferred embodiment of the food preservation container of the present invention. The preferred embodiment of the present invention is comprised of a container 2 and a lid assembly 200. The container 2 is made of rigid blow molded plastic such as high density polypropylene or polypropaline or the like. The overall shape is rounded so as to more easily accommodate internal air pressure or vacuum. Ribs 6, 8 and indentations 10, 12 help to add reinforcement to the hollow container 2. The lid assembly 200 is attached to the container by hinge member 30. Lid assembly 200 has an outer cover 4 that is molded out of rigid plastic. The outer cover 4 is circular in shape and has an integral side wall that terminates in a lip that contains a plurality of inwardly facing tabs 16. These tabs 16 interface with mating tabs 14 that extend outwardly from the lip of container opening 38. The tabs 16 on container 2 can be clearly seen in FIG. 2 where a front view of the container 2 is shown. The inwardly facing tabs 14 of the lid assembly 200 and the hinge portion 30 can be more clearly seen in FIG. 3.

Figure 4:
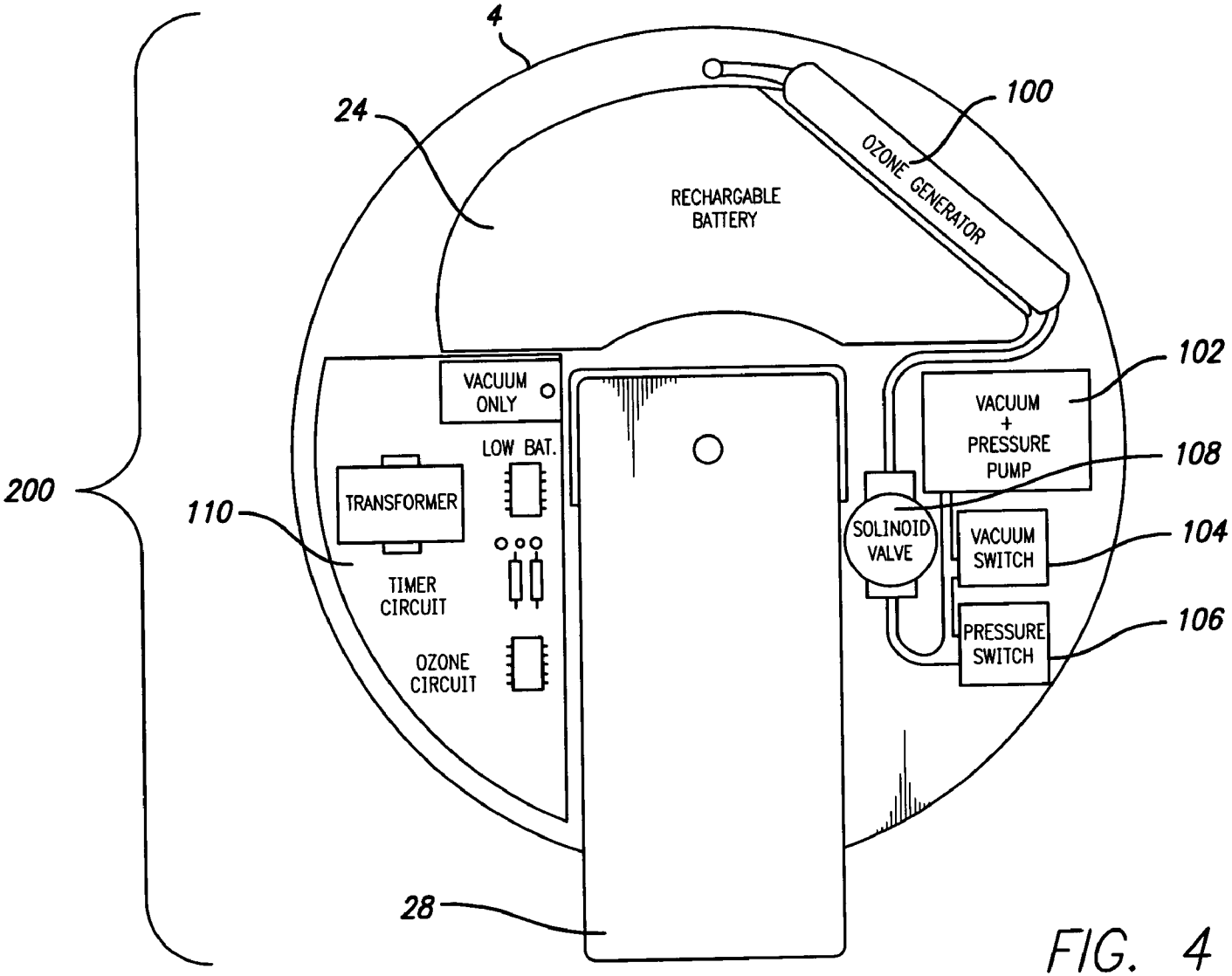
FIG. 4 is a plan view of the contents within the lid of the present invention.

FIG. 4 shows a view of the inside of the lid assembly 200. In a preferred embodiment of the invention, the components within the lid housing 4 are a rechargeable battery 24, an ozone generator 100, a vacuum-pressure pump 102, a vacuum cutoff switch 104, a pressure cutoff switch 106, a solenoid valve 108 and a microprocessor circuit 110 that provides timing functions as well as a driving circuit for the ozone generator 100. Some of the inner lid components can also be seen in side section view in FIG. 1.

Figure 5:
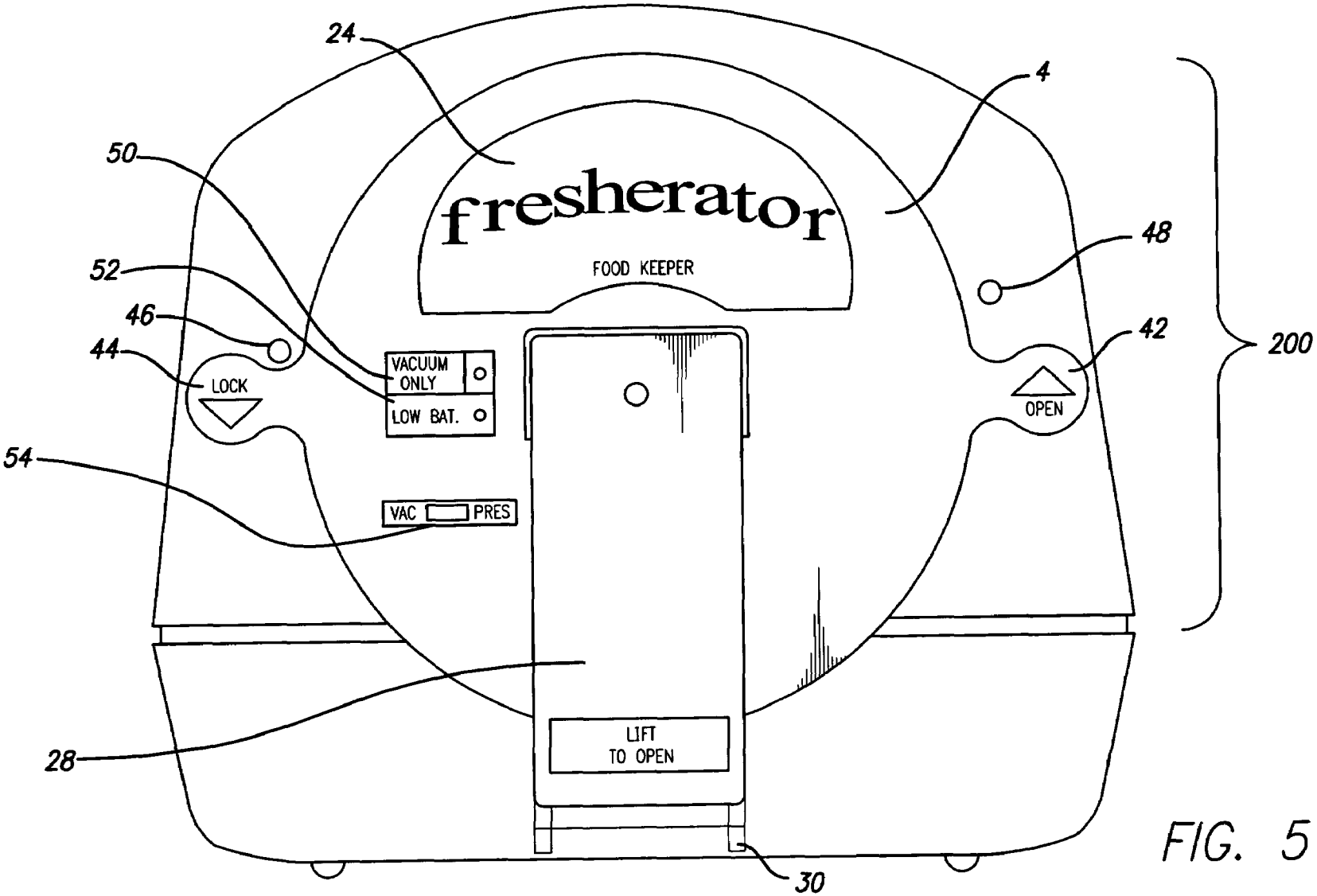
FIG. 5 is a front view of the present invention with the lid in the closed position.

To use the present invention, the user opens the lid assembly 200 by lifting lever 28 thereby eliminating the pressure that has been exerted on inner lid 22 by the integral cam that is at one end of lever 28 as shown in FIG. 1. The user then rotates the lid assembly 200 by knob 42, 44 shown in FIG. 5. The user presses down on knob 44 and pulls up on knob 42 until the knob hits post 48. The user can then swing the door open on its hinge 30. The user then puts in or takes out food that is stored within container 2. The user then closes lid assembly 200 in the reverse order as the opening sequence. In pressing down on lever 28, the lever's integral cam pushes on floating inner plate 22. Inner plate 22 has a rubber gasket 18 fastened to its perimeter so that the gasket 18 presses onto container opening lip 16 creating an air tight seal. This seal is effective in maintaining a vacuum or pressure within the container 2. Upon closing lid assembly 200, on-ff switch 65 is activated when inner lid plate 22 strikes the switch 65 plunger. This in turn activates the pump 102 which can be set by slide switch 54 to produce a vacuum or pressure, depending on the type of food being stored.

Foods such as fresh fruits and vegetables respond favorably to pressure and other foods such as cheese, meats and fish respond favorably to vacuum. My experiments have shown that a pressure of approximately five pounds per square inch work well for fruits and vegetables and a vacuum of approximately ten inches of mercury works well for vacuum applications. These relatively low settings also allow the container 2 and lid parts 4, 22 to be molded from rigid plastic. Higher pressures or vacuums would require thicker walls and more ribs and higher quality plastic such as polycarbonate that would increase the overall price of the food preservation container thereby making it more difficult to sell the general public.

When the selector switch 54 is set to vacuum and the lid closed, the vacuum pump 102 and the ozone generator 100 are activated and solenoid valve 108 is opened for a period of approximately three minutes as dictated by microprocessor circuit 110. This causes ozone to be drawn through the container 2 and out through solenoid 108. My experiments show that approximately one part per million of ozone is enough to kill mold and bacteria that are present on the surface of the food stored within container 2. My experiments also show that less one tenth of one part per million of ozone escapes from the container when the lid is opened. This is below the EPA guidelines for safe exposure to ozone.

After three minutes the solenoid valve 108 closes and vacuum pump 102 continues to pump air out of the container 2 until proper vacuum is reached at which point vacuum pressure switch turns off the pump 102. If, over time, the vacuum is diminished within container 2, pump 102 automatically turns on to replenish the vacuum. After approximately twelve hours solenoid valve 108 is automatically opened to flush out gasses that have built up within container 2. The valve 108 is then closed again and the vacuum is replenished. This sequence recurs twelve hours to continue to expel harmful out gassing from food stored within container 2. The same basic sequence occurs when the user sets selector switch 54 to pressure, except that instead of a vacuum being created in the container 2, a positive pressure is created and the pump is turned off by pressure switch 106 when proper pressure is reached. The same periodic air purging occurs, and the same ozone generation occurs.

The pump and ozone generator are preferably powered by replaceable rechargeable battery 24. Of course, other power supply's can be used including standard house voltage. The entire unit of the present invention is designed to be placed in a standard home refrigerator which is why the preferred embodiment makes use of a rechargeable battery. In the preferred embodiment, a recharging stand has a second battery being charged. When the user notices that low battery indicator 52 is lit, it is time for the user to replace the exhausted battery 24 with a recharged battery. The unit of the present invention is designed to use little energy, approximately two hundred millivots at twelve volts, therefore the battery only has to be replaced once every four weeks. My experiments have shown that foods can remain fresh three to five times longer than when stored under normal refrigerator conditions.

Figure 6:
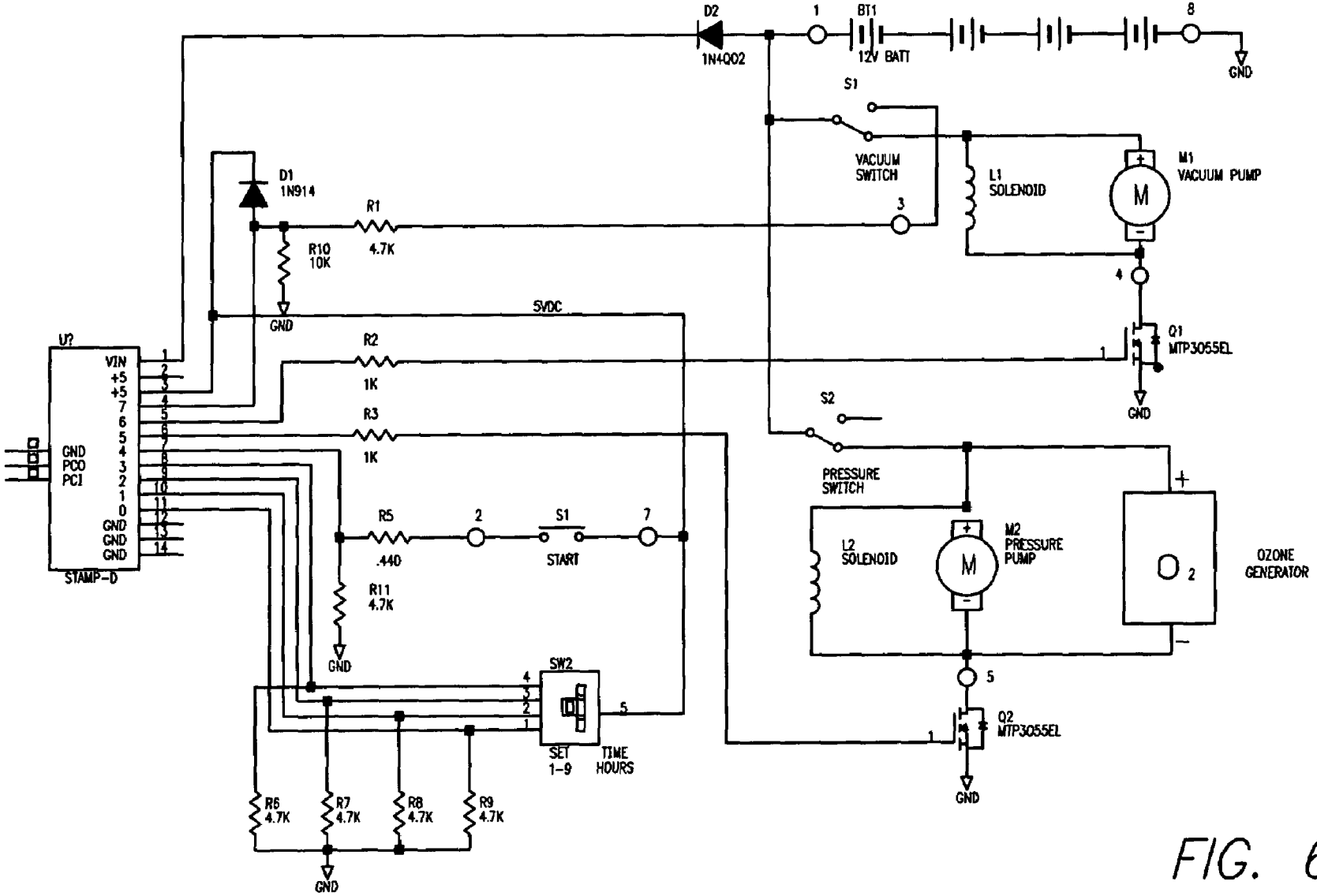
FIG. 6 is a schematic drawing of the electronic timing circuit of the present invention.

Different foods show different degrees of response to vacuum or pressure but in general, the result is always favorable in that foods remain fresh longer. FIG. 6 is a schematic view of the electronic circuit of the present invention. The above described and illustrated way shows that the present invention is easy to use and allows a person to store a wide variety of foods in either a pressure environment or a vacuum environment that has been ozinated thereby extending the useful life of the food stored within.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A food preservation container, comprising:

a main container body;

a circular lid having an integral side wall;

said lid having a built in on-off switch, air pump, ozone generator, timing circuit, pressure switch, vacuum switch, solenoid valve, power indicating light, vacuum indicator light, pressure indicator light and power supply;

said container having a circular opening;

said opening having a plurality of outwardly facing tabs about its circumference;

said lid having plurality of mating inwardly facing tabs that can interface with said outwardly facing tabs;

said lid having a lower hinge portion that combines with a mating hinge portion on the lower front portion of said container opening;

said lid having a secondary floating inner lid;

said inner lid having a soft rubber gasket attached to its perimeter;

said inner lid capable of being forced toward the lip of said container opening by a cam attached to a hinged lever located on the front of said circular lid;

said power supply being removable and replaceable from the front of said lid;

said components contained within said lid arranged in such a way that said air pump automatically turns on when the user twists said lid onto said container opening thereby activating said on-off switch which turns on said pump;

said pump being automatically turned off when a predetermined pressure or vacuum is reached by means of said pressure switch or said vacuum switch;

said ozone generator automatically turned on for a predetermined period of time and turned automatically turned off by means of said timing circuit;

said ozone generator being comprised of a corona discharge tube and a high voltage circuit that powers said tube;

said timing circuit being comprised of a microprocessor and discrete electronic components associated with said microprocessor; and said air in said container capable of being periodically released by said solenoid valve that is controlled by said timing circuit.

2. The food Preservation Container of claim 1 wherein said container is made of blow molded plastic such as polypropylene.

3. The food preservation of claim 1 wherein said lid is made of injection molded plastic such as ABS.

4. A food preservation container comprising:

a main container body having a cavity;

an air pump in communication with the cavity of the main container body, the air pump having a vacuum mode adapted to create a vacuum in the main container body cavity and a pressure mode adapted to create positive pressure in the main container body cavity, wherein the air pump can selectively be operated in the vacuum mode and the pressure mode; and an ozone generator adapted to generate ozone in the main body container cavity.

5. A food preservation container, comprising:

a main container body having a cavity;

an air pump in communication with the cavity of the main container body, the air pump having a vacuum mode adapted to create a vacuum in the main container body cavity and a pressure mode adapted to create positive pressure in the main container body cavity, wherein the air pump can selectively be operated in the vacuum mode and the pressure mode; and a lid sealingly engageable with the main container body wherein the lid is operatively connected to the air pump and is adapted to activate the air pump when the lid sealingly engages the main container body.

6. A food preservation container, comprising:

a main container body having a cavity;

an air pump in communication with the cavity of the main container body, the air pump having a vacuum mode adapted to create a vacuum in the main container body cavity and a pressure mode adapted to create positive pressure in the main container body cavity, wherein the air pump can selectively be operated in the vacuum mode and the pressure mode; and a sensor operatively connected to the air pump, wherein the sensor and the air pump are adapted to maintain a predetermined pressure or vacuum.

7. A food preservation containers, comprising:

a main container body having a cavity;

an air pump in communication with the cavity of the main container body, the air pump having a vacuum mode adapted to create a vacuum in the main container body cavity and a pressure mode adapted to create positive pressure in the main container body cavity, wherein the air pump can selectively be operated in the vacuum mode and the pressure mode; and a timing circuit operatively connected to a valve, wherein the timing circuit selectively opens the valve to replace pressurized or vacuumized air at specified intervals.

8. A method of preserving food, comprising the steps of:

providing a container having an air pump, wherein the air pump is configured to selectively create a vacuum or create positive pressure in the container;

activating the air pump to create positive pressure in the container;

providing an ozone generator; and emitting ozone into the container.

9. A method of preserving food, comprising the steps of:

providing a container having an air pump, wherein the air pump is configured to selectively create a vacuum or create positive pressure in the container;

activating the air pump to create positive pressure in the container;

providing a sensor;

sensing the pressure in the container; and activating the air pump to maintain a preselected pressure.

10. The method of claim 9, further comprising the steps of:

at preselected time interval, repressurizing the container.

* * * * *